US005826203A

United States Patent [19]

Fukumoto et al.

[11] Patent Number: 5,826,203

[45] Date of Patent: Oct. 20, 1998

[54] METHOD FOR SOLIDIFYING WASTE CONTAINING RADIOACTIVE IODINE

[75] Inventors: Masahiro Fukumoto, Abiko; Manabu Kanzaki, Naka-gun, both of Japan

[73] Assignee: Doryokuro Kakunenryo Kaihatsu Jigyodan, Tokyo-to, Japan

[21] Appl. No.: 892,232

[22] Filed: Jul. 14, 1997

[30] Foreign Application Priority Data

Aug. 20, 1996 [JP] Japan ..... 8-218379

[51] Int. Cl.[6] ..... G21F 9/00

[52] U.S. Cl. ..... 588/15; 588/16; 976/DIG. 392

[58] Field of Search ..... 588/15, 16; 75/247, 75/246; 976/DIG. 392

[56] References Cited

U.S. PATENT DOCUMENTS

| | | | |
|---|---|---|---|
| 3,262,885 | 7/1966 | Rushbrook | 588/14 |
| 4,088,737 | 5/1978 | Thomas et al. | 423/240 |
| 4,661,291 | 4/1987 | Yamasaki et al. | 252/629 |

FOREIGN PATENT DOCUMENTS

| | | |
|---|---|---|
| 0230740 | 8/1987 | European Pat. Off. . |
| 0327271 | 8/1989 | European Pat. Off. . |
| 0361773 | 4/1990 | European Pat. Off. . |
| 63-206700 | 8/1988 | Japan . |
| WO80/01217 | 6/1980 | WIPO . |

OTHER PUBLICATIONS

Patent Abstracts of Japan, vol. 016, No. 536 (P–1449), Nov. 6, 1992, & JP 04 204099 A (Hitachi Ltd), Jul. 24, 1992.

*Primary Examiner*—Ngoclan Mai

*Attorney, Agent, or Firm*—Wenderoth, Lind & Ponack, L.L.P.

[57] ABSTRACT

A method for solidifying a radioactive iodine-containing waste, in which volatilization of radioactive iodine outward can be suppressed during solidification, and a solidified waste having a high level of confinement of radioactive iodine and a long term stability can be obtained. The method comprised mixing a granular waste containing radioactive iodine, e.g. a granular iodine adsorbent having radioactive iodine adsorbed and collected thereon, with a metal powder, e.g. a copper powder, having a corrosion resistance in an environment of solidified waste disposal, filling the resulting mixture in a metal capsule, and subjecting the whole to hot isostatic pressing to effect solidification. In the resulting solidified waste, particles of the radioactive iodine-containing adsorbents are dispersed and retained in the sintered matrix of the metal powder formed through the isostatic pressing.

8 Claims, 3 Drawing Sheets

METHOD FOR SOLIDIFYING WASTE CONTAINING RADIOACTIVE IODINE

BACKGROUND OF THE INVENTION

The present invention relates to a method for preparing a solidified waste suitable for final disposal by the solidification of an iodine-containing waste containing iodine-129 of long half life in particular, such as an adsorbent having radioactive iodine generated in a spent nuclear fuel reprocessing plant adsorbed thereon.

Since radioactive iodine, which is one of volatile radioactive nuclides generated in the course of spent nuclear fuel reprocessing in a spent nuclear fuel reprocessing plant, is contained in off-gas, the influence thereof on the environment is usually suppressed by scrubbing the off-gas with an alkali solution or by passing the off-gas through a filter packed with an iodine adsorbent to adsorb thereon radioactive iodine for removal thereof.

The adsorptive removal with an iodine adsorbent has been becoming a mainstream method. The iodine adsorbent having radioactive iodine adsorbed and collected thereon is solidified as a radioactive iodine-containing waste to be ready for final disposal.

Various methods have been proposed as the solidification method, examples of which include a low-melting vitrification method wherein a radioactive iodine-containing solid waste containing copper iodide or lead iodide as the radioactive iodine is sealed and solidified in a glass capable of softening at a temperature of 480° C. or below (Japanese Patent Laid-Open No. 62-124,500/1987), a hydrothermal solidification method wherein lead iodide containing radioactive iodine is mixed with a silicate and an alkali solution, and then subjected to a hydrothermal reaction under a pressure of 100 to 500 kg/cm$^2$ at a temperature of 150° to 300° C. (Japanese Patent Laid-Open No. 62-15,497/1987), an HIP method wherein a mixture of an alkali solution with a ceramic waste containing radioactive iodine is filled in a metal capsule, and the whole is subjected to hot isostatic pressing (HIP) to effect a hydrothermal reaction to thereby solidify the waste (Japanese Patent Laid-open No. 5-80,197/1993), and a low-melting metal solidification method wherein an adsorbent having radioactive iodine adsorbed thereon is sealed and solidified in a metal, alloy or metal compound having a melting point equal to or lower than the temperature to be much volatile or decomposition temperature of radioactive iodine (Japanese Patent Laid-Open No. 4-204,099/1992).

In general, the problems with the solidification of radioactive iodine are that stable confinement of iodine-129 must be secured over a long period because it is a nuclide having a long half life, and that volatilization thereof outward must be suppressed during the treatment because it is volatile. From the standpoint of suppression of volatilization of radioactive iodine outward, the above-mentioned low-melting vitrification method, hydrothermal solidification method and low-melting metal solidification method of the prior art involve conversion of iodine into its compounds or lowering of the treatment temperature to suppress volatilization of iodine, while the HIP method of the prior art involves the treatment of iodine in the metal capsule to suppress volatilization of iodine. In respect of confinement of radioactive iodine, however, the stability of the solidified waste is not necessarily satisfactory in the low-melting vitrification method and the low-melting metal solidification method as compared with the case where an ordinary glass or metal is used. On the other hand, in the solidification method involving a hydrothermal reaction, the resulting solidified waste becomes porous and hence cannot necessarily be said to be satisfactory in respects of stability and corrosion resistance because the waste to be treated contains water.

SUMMARY OF THE INVENTION

An object of the present invention is to provide a method for solidifying a radioactive iodine-containing waste according to which volatilization of radioactive iodine out of the system can be effectively suppressed during solidification, while a solidified waste endowed with a high level of confinement of radioactive iodine and a long term stability can be obtained.

The method of the present invention for solidifying a waste containing radioactive iodine is characterized by mixing a granular waste containing radioactive iodine with a metal powder having a corrosion resistance in an environment of solidified waste disposal, filling the resulting mixture in a metal capsule, and subjecting the whole to hot isostatic pressing to effect solidification.

Although the method of the present invention is similar to the aforementioned HIP method of the prior art (Japanese Patent Laid-Open No. 5-80,197/1993) in respect of the hot isostatic pressing (HIP) of a metal capsule filled with a waste to be treated, the method of the present invention is different from the HIP method of the prior art in that a waste to be treated in the former is a mixture prepared by mixing a waste containing radioactive iodine with a metal powder having a corrosion resistance in an environment of solidified waste disposal such as a deep underground, whereas a waste to be treated in the latter is a mixture prepared by adding an alkali solution to a ceramic waste containing radioactive iodine. In the present invention, therefore, a water-free waste as the object of treatment is subjected to HIP to prepare a dense solidified waste wherein particles of the radioactive iodine-containing waste are dispersed and retained in the sintered matrix of the metal powder formed at a temperature lower than the melting point thereof through the isostatic pressing. This solidified waste is endowed with an excellent corrosion resistance in an environment of disposal and is also excellent in the capability of confining radioactive iodine and in mechanical properties such as compressive strength.

As for suppression of volatilization of radioactive iodine during the treatment, release of iodine outward can be effectively suppressed by carrying out HIP in a state in which the waste to be treated is confined in the metal capsule.

PREFERRED EMBODIMENTS OF THE INVENTION

Figure 1:
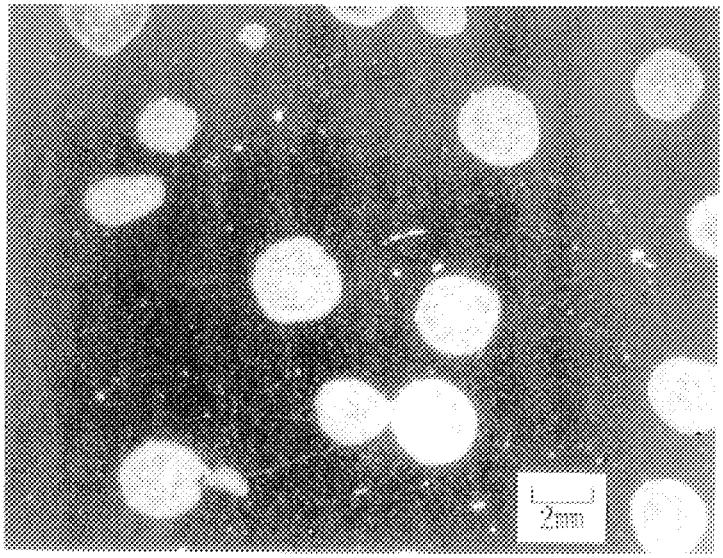
FIG. 1 is an optical photomicrograph of a cross section of a solidified waste obtained according to the present invention.

Granular Silver Zeolite (AgX) or Silver Silica Gel (AgS) of 1 to several mm in diameter is generally used as the iodine adsorbent. Radioactive iodine is reacted with silver to be converted into silver iodide (AgI), in the form of which iodine is adsorbed and collected on the adsorbent. In the present invention, the granular adsorbent having radioactive iodine collected thereon can be subjected as a radioactive iodine-containing waste to solidification.

When the AgI collected on the iodine adsorbent, which is a difficultly soluble compound, is disposed of in a deep underground, AgI is reduced to iodide ions ($I^-$) to become liable to be dissolved in underground water because the deep underground is a reducing environment substantially free of dissolved oxygen. In view of this, a metal powder having a corrosion resistance in the reducing environment is used in the present invention to confine the iodine adsorbent having iodine collected thereon as AgI in the matrix of a dense sintered body of this metal powder, whereby dissolution of radioactive iodine into underground water in the disposal environment can be hindered with certainty.

Examples of the metal having a corrosion resistance in the reducing environment include copper, silver, gold, platinum and the like, which have an oxidation-reduction potential higher than that in a hydrogen evolution reaction. Among them, copper is preferred for practical use. Any copper alloy having a corrosion resistance in the reducing environment may also be used.

Further, metals comparatively low in oxidation-reduction potential, e.g., stainless steel, nickel, titanium and the like, can be used as the metal having a corrosion resistance since they are capable of forming an oxide film (passive film) excellent in corrosion resistance on the surfaces thereof.

A metal having a corrosion resistance in an environment of solidified waste disposal, examples of which include copper, stainless steel and the like, can be preferably used as the material of the metal capsule to be filled with the waste to be treated because it serves as an outer shell of the solidified waste. However, the corrosion resistance of the metal capsule itself, which is the outer shell of the solidified waste, may not so much be expected in so far as the corrosion resistance of the matrix of the sintered body of the metal powder inside the capsule is satisfactory.

As for the temperature conditions for the HIP, the temperature is required to allow sintering of the metal powder to proceed, and is at least above the recrystallization temperature of the metal (temperature about one half of the melting point, about 600° C. in the case of copper), preferably 0.8-fold as high as the melting point (about 870° C. in the case of copper). The upper limit of the temperature is lower than the decomposition temperature of the iodine compound in the radioactive iodine-containing waste. Although the treatment is desirably effected at as low a temperature as possible in order to suppress desorption of the radioactive iodine compound adsorbed on the iodine adsorbent, no problem arises in so far as the radioactive iodine compound, even if desorbed, is dispersed and retained in the matrix of the sintered body inside the metal capsule.

As for the pressure conditions for the HIP, the pressure is required to be such that a sufficiently dense metal matrix can be obtained when the metal powder is sintered. Although as high a pressure as possible is desired in order to promote the densification of the metal matrix, the pressure possible in the HIP now in use is around 200 MPa.

EXAMPLE

Production of solidified waste

Silver Zeolite (AgX) and Silver Silica Gel (AgS) were each used as the granular iodine adsorbent to adsorb thereon iodine in the following manner. AgX was heated at 500° C. to effect dehydration, followed by adsorption thereon of iodine batchwise at 100° C. using solid iodine. The amount of adsorbed iodine was 146 mg $I_2$/g AgX. Iodine was similarly adsorbed on AgS batchwise at 150° C., followed by heating at 400° C. for dehydration. The amount of adsorbed iodine was 70 mg $I_2$/g AgS.

Each of the resulting simulated iodine adsorbent wastes was mixed with a pure copper powder (100 to 200 mesh) at a volume ratio of 1:1. The resulting mixture was filled in a pure copper capsule (in a cylindrical form having an inner diameter of 45 mm, an inner height of 100 mm and a wall thickness of 3 mm), and then preliminarily compressed under a pressure of 48.9 MPa in an argon atmosphere at room temperature. Subsequently, the capsule was evacuated to deair and then hermetically sealed to effect HIP. The HIP conditions involved a temperature of 860° C., a pressure of 195 MPa, a retention time of 3 hours, and the use of argon as the pressure medium.

The result of observation of a cross section of the resulting solidified waste under an optical microscope revealed that the iodine adsorbent was dispersed in the sintered matrix of the copper powder in a state of maintaining a particulate form as is understandable from the photograph of FIG. 1. As a result of observation of the solidified waste with a scanning electron microscope/energy dispersive X-ray analyzer, it was confirmed that iodine was detected in the part of the adsorbent, and that almost all of iodine was confined in the sintered matrix in a state of being retained inside the adsorbent. Measurement of polarization characteristics:

For comparison in corrosion behavior between pure copper and the solidified waste obtained in a state in which the granular iodine adsorbents (either AgX or AgS) were confined in the sintered matrix of the copper powder, the polarization characteristics thereof were measured in an environment having an ultralow dissolved oxygen concentration and a high alkalinity as a hypothetic underground disposal environment. Adsorbents having no iodine adsorbed thereon as well as the adsorbents having iodine adsorbed thereon were subjected to the measurement in order to examine the influences of existence or nonexistence of iodine. The test was carried out according to a procedure comprising dipping a test piece in a liquid, applying an electric potential thereto, and making a sweep of electric potential to measure values of electric current flowing therethrough. The test conditions involved the use of a saturated solution of calcium hydroxide, a temperature of 50° C., a dissolved oxygen concentration of 10 ppb or less, and an electric potential sweep rate of 20 mV/min, while the test environment was such that the pH is 13.0 and the Eh (oxidation-reduction potential) is +122 $mV_{SCE}$. The results are shown in FIG. 2 (cathodic polarization characteristics) and FIG. 3 (anodic polarization characteristics).

Figure 2:
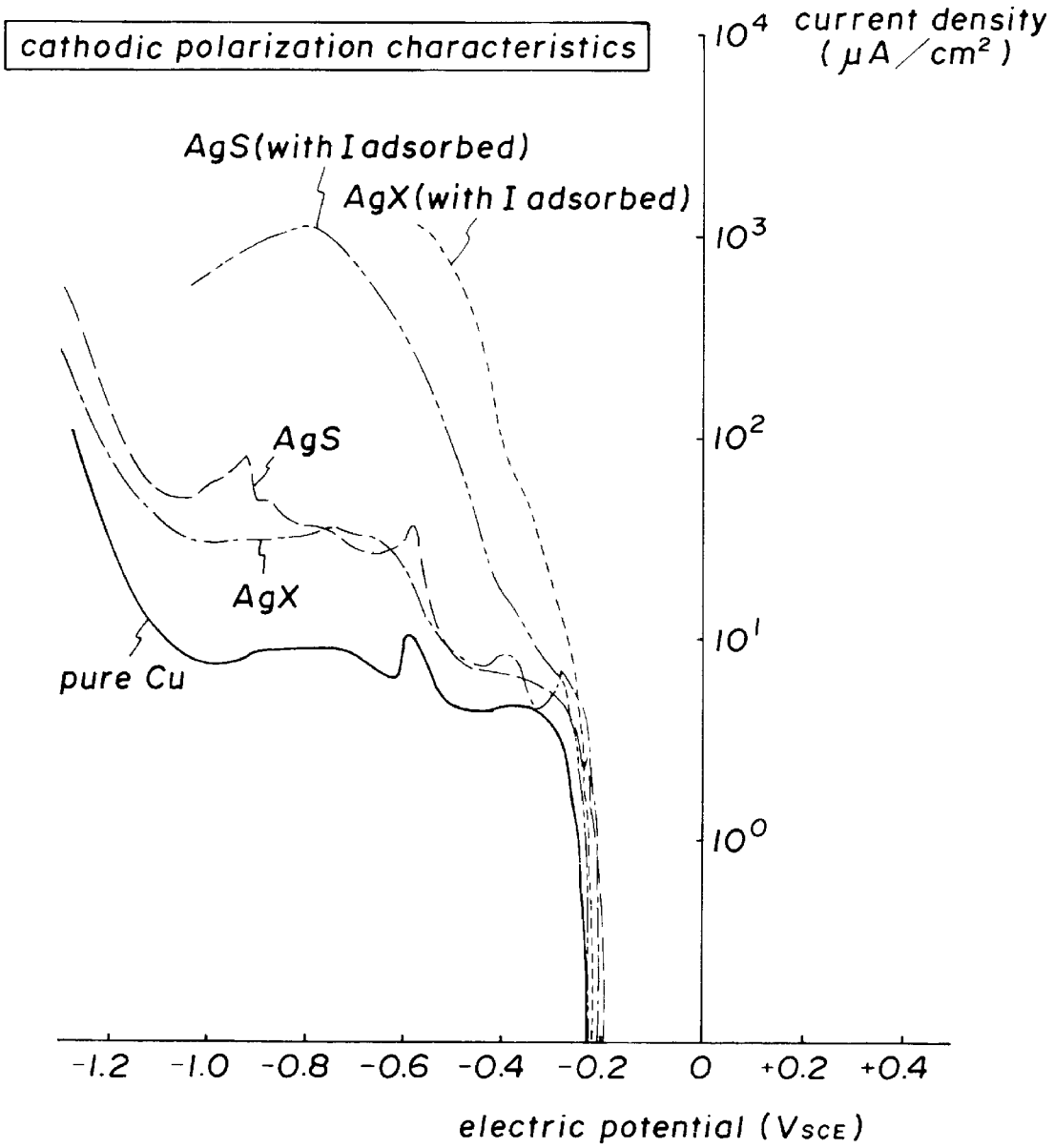
FIG. 2 is a graph showing the cathodic polarization characteristics found by polarization measurement on solidified wastes and a pure copper sample.
Figure 3:
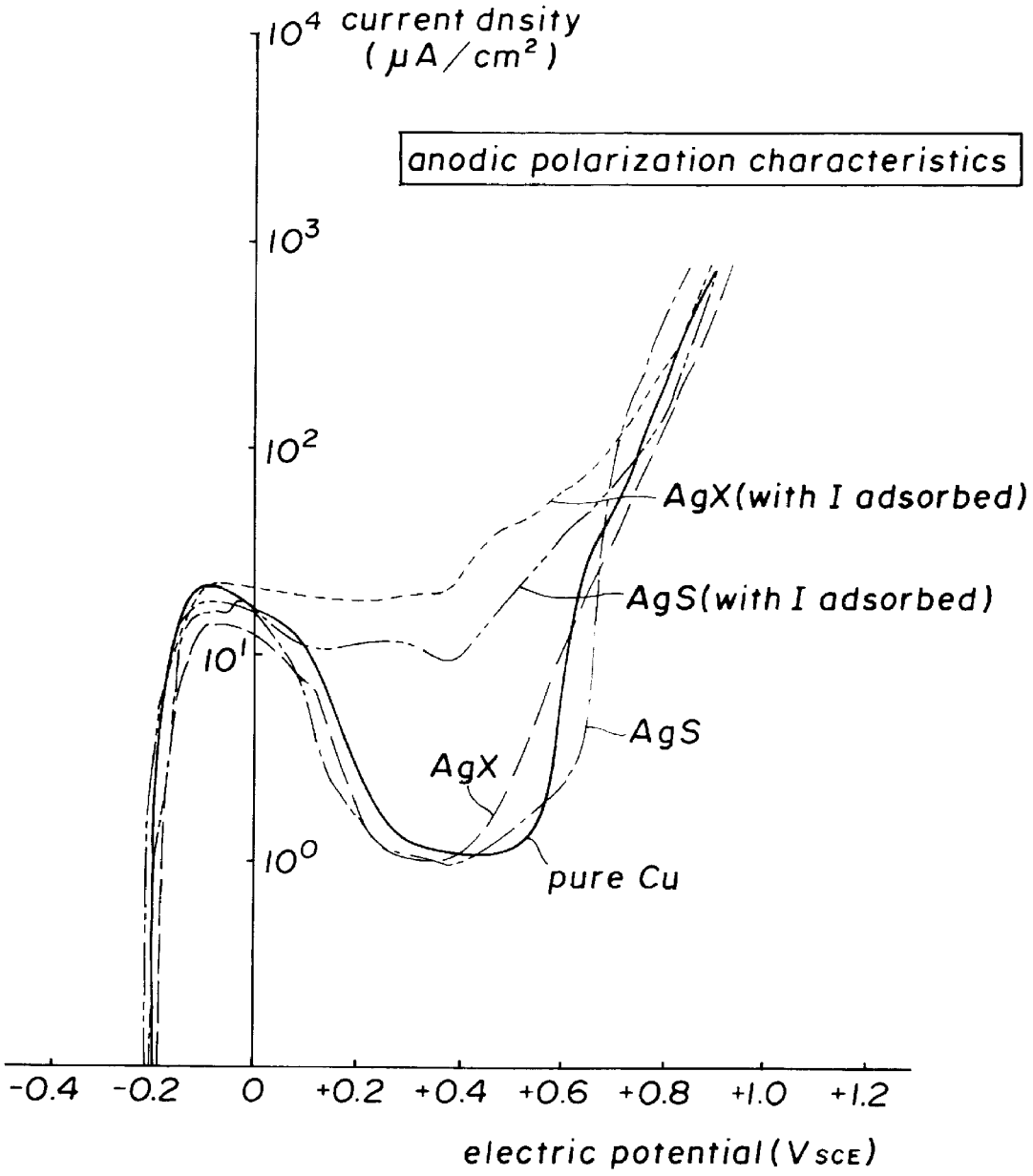
FIG. 3 is a graph showing the anodic polarization characteristics found by polarization measurement on the solidified wastes and a pure copper sample.

Since the current density was higher in the case of the adsorbents having iodine adsorbed thereon than in the case of the adsorbents having no iodine adsorbed thereon as understandable from FIG. 2, the existence of iodine accelerated a cathode reaction. It can be further understood from FIG. 3 that an anodic reaction was also accelerated in a passivation region (range of +0.1 to +0.6 $V_{SCE}$ wherein a passive film is formed on pure copper) due to the existence of iodine. Since, however, the corrosion potentials (about −0.2 $V_{SCE}$) of the solidified wastes were equal to that of pure copper and hence were not affected by the existence or nonexistence of iodine, it can be inferred that copper in the solidified wastes exhibited a corrosion resistance equivalent to that of pure copper in the reducing environment having an electric potential around or below the corrosion potential.

As is understandable from the foregoing description, since a solidified waste obtained according to the present invention is in such a state that waste particles containing radioactive iodine are confined in a dense sintered matrix of a metal powder having a corrosion resistance in the disposal environment, it is endowed with such a stable capability of confining radioactive iodine that it does not dissolve out over a long period. In the case of using a copper powder in particular, a very stable solidified waste free from corrosion even in the reducing environment can be obtained since the oxidation-reduction potential of copper is higher than that in a hydrogen evolution reaction.

Furthermore, volatilization of radioactive iodine outward can be effectively suppressed during HIP when a waste to be treated is filled in a metal capsule and then subjected in a hermetically sealed state to the treatment.

What is claimed is:

1. A method for solidifying a waste containing radioactive iodine, characterized by mixing a granular waste containing radioactive iodine with a metal powder having a corrosion resistance in an environment of solidified waste disposal, filling the resulting mixture in a metal capsule, and subjecting the whole to hot isostatic pressing to effect solidification.

2. A solidification method as claimed in claim 1, wherein a metal powder having an oxidation-reduction potential higher than that in a hydrogen evolution reaction is used as said metal powder.

3. A solidification method as claimed in claim 2, wherein a copper powder is used as said metal power.

4. A solidification method as claimed in claim 1, wherein a powder of stainless steel, nickel or titanium is used as said metal powder.

5. A solidification method as claimed in claim 1, wherein said granular waste is a granular iodine adsorbent having radioactive iodine adsorbed and collected thereon.

6. A solidification method as claimed in claim 5, wherein said iodine adsorbent is Silver Zeolite or Silver Silica Gel.

7. A solidification method as claimed in claim 1, wherein said metal capsule is made of copper or stainless steel.

8. A solidification method as claimed in claim 1, wherein said hot isostatic pressing is carried out at a temperature sufficient to allow sintering of said metal powder to proceed and under a pressure sufficient to obtain a dense metal matrix of the sintered metal powder.

* * * * *